United States Patent [19]

Jannach et al.

[11] Patent Number: 4,727,656

[45] Date of Patent: Mar. 1, 1988

[54] DEVICE FOR DRYING FOOTWEAR

[76] Inventors: Helmut Jannach, Prokoppigasse 2, A-8010 Graz (Osterreich); Hermann Obrist, Hochtennstrasse 19, A-5700 Zell AM SEE (Osterreich), both of Austria

[21] Appl. No.: 40,481

[22] Filed: Apr. 20, 1987

[30] Foreign Application Priority Data

Apr. 22, 1986 [AT] Austria ..... 1066/86

[51] Int. Cl.[4] ..... F26B 9/00

[52] U.S. Cl. ..... 34/104; 34/232; 34/239

[58] Field of Search ..... 34/104, 239, 232

[56] References Cited

U.S. PATENT DOCUMENTS

| | | | |
|---|---|---|---|
| 3,793,744 | 2/1974 | Saita | 34/104 |
| 3,798,788 | 3/1974 | Kuntz | 34/104 |
| 4,136,464 | 1/1979 | Hay | 34/104 |
| 4,200,993 | 5/1980 | Blanc | 34/104 |

*Primary Examiner*—Larry I. Schwartz

*Attorney, Agent, or Firm*—Bierman and Muserlian

[57] ABSTRACT

A device for drying footwear comprising a holding element on which the footwear to be dried is slipped onto, means for conducting warm air through the holding element into the footwear through at least one discharge port and at least one carrier organ to distribute the warm air characterized in that the holding elements are formed by tube bends (1', 11') of at least one pipe coil (1, 11) with the discharge ports (18,16) arranged in the downward pointing area of one of the ends of the curve of the tube bend.

3 Claims, 5 Drawing Figures

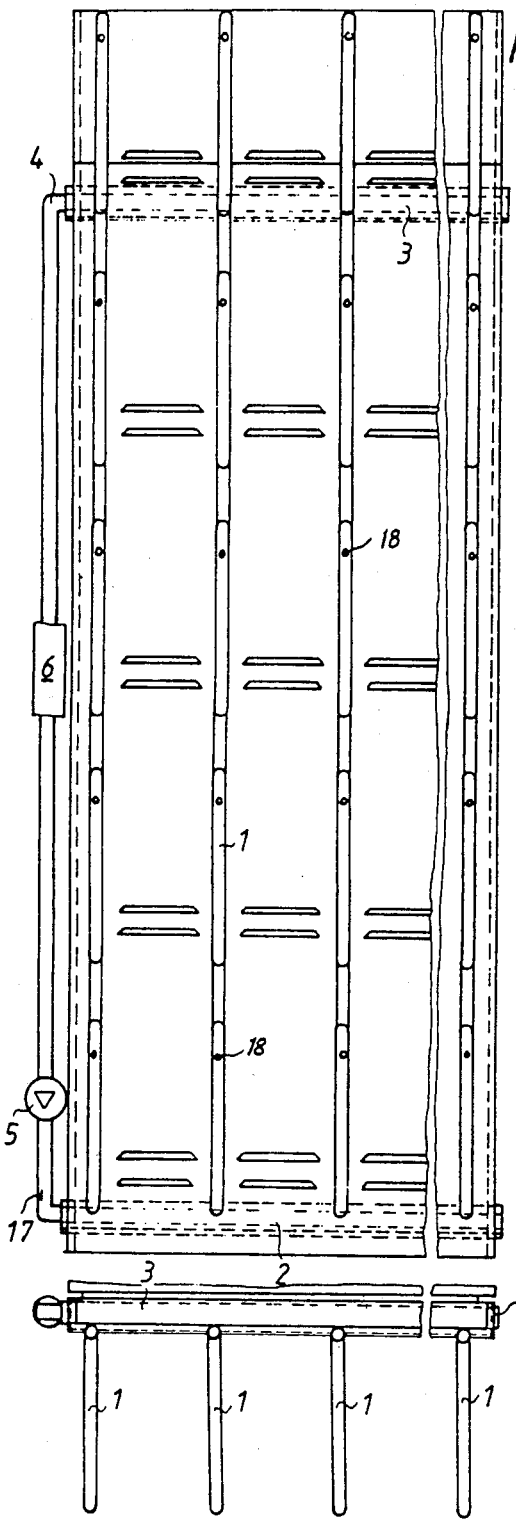
FIG. 2
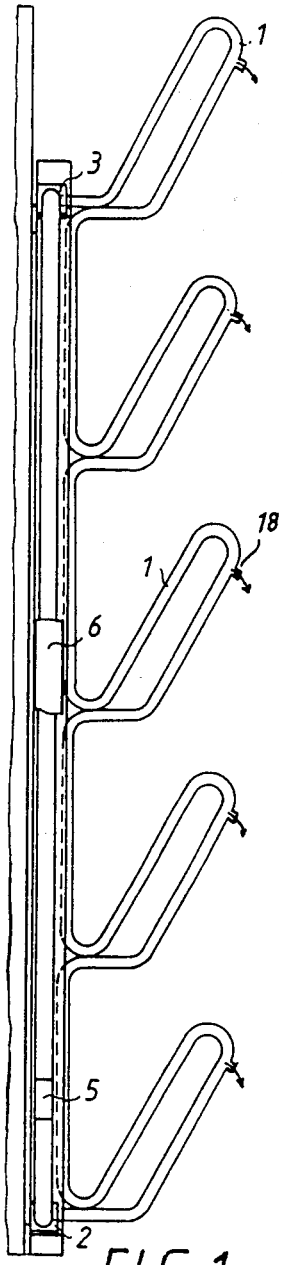
FIG. 1
FIG. 3

DEVICE FOR DRYING FOOTWEAR

STATE OF THE ART

In a known footwear drying device, the holding elements are formed by pipe sockets which at their free end display a discharge port for warm air onto which holding element the shoes are slipped so that the warm air discharging ports come to be situated within the zone of the tips of the shoes. Such a design has the disadvantage that, particularly in the case of shoes with a soft inner lining, the discharge port may become obstructed with the result that the air escapes at the other discharge ports of the adjacent holding parts, and the shoes, where the discharge ports are completely or partially blocked by the lining, are not dried. In addition, because of the rather sharp-edged design of the ends of the holding parts, the inside of the shoes may become damaged, especially when the shoes are carelessly slipped onto the holding parts. A further disadvantage of the known construction can also be seen in that the sharp-edges of the free ends of the holding elements can lead to severe injuries of individuals, since experience has shown that ski-boot rooms often have wet or slippery floors, so that a person slipping on the floor and seeking to grasp a hold in the area of the shoe-drier can suffer an injury from the free ends of the holding elements.

OBJECTS OF THE INVENTION

It is an object of the invention to provide a footwear drying device free of the above disadvantages and which can be simply and economically manufactured.

This and other objects and advantages of the invention will become obvious from the following detailed description.

THE INVENTION

The device of the invention for drying footwear comprising a holding element on which the footwear to be dried is slipped onto, means for conducting warm air through the holding element into the footwear through at least one discharge port and at least one carrier organ to distribute the warm air is characterized in that the holding elements are formed by tube bends (1', 11') of at least one pipe coil (1, 11) with the discharge ports (18, 16) arranged in the downward pointing area of one of the ends of the curve of the tube bend.

By such a design of the holding element, damage to the inside of the shoe is fully prevented, with a reliable firm seating of the shoes being achieved by the parallel ledges of the tube bends. This is of great importance for shoe-renting establishments, for example, in which the shoes are arranged by size and type, and where, besides the purely visual impression, order must prevail inasmuch as the shoes must be arranged in an appropriate order by both size and inventory number so as to provide the necessary overview.

In addition, in the claimed construction, the shoe can be slipped onto the holding element by its shank so that the warm air is blown into the tips of the shoe without the holding elements reaching into the tips. Moreover, shoes are not so vulnerable in the shank area as in the area of the tips where they tend to pinch more in the event of any deformation. Thus, low shoes, e.g., cross-country shoes, can also be dried on the device since they can be hung in the same manner with the heel over the tube bend, whereat, by virtue of the position of the discharge port, the warm air is reliably blown into the tip resulting in the desired drying.

A further advantage also lies in that at shoe-renting or similar establishments, the shoes may remain on the drying device, serving as a storage device since because of the design of the holding element, the shoe will suffer no damage on the inside, even when they stay on these holding elements for a long period of time.

Referring now to the drawings:

FIG. 1 is a side view of an embodiment of the invention and

FIGS. 2 and 3 are a front view and a plan view, respectively of the said embodiment.

Figure 4:
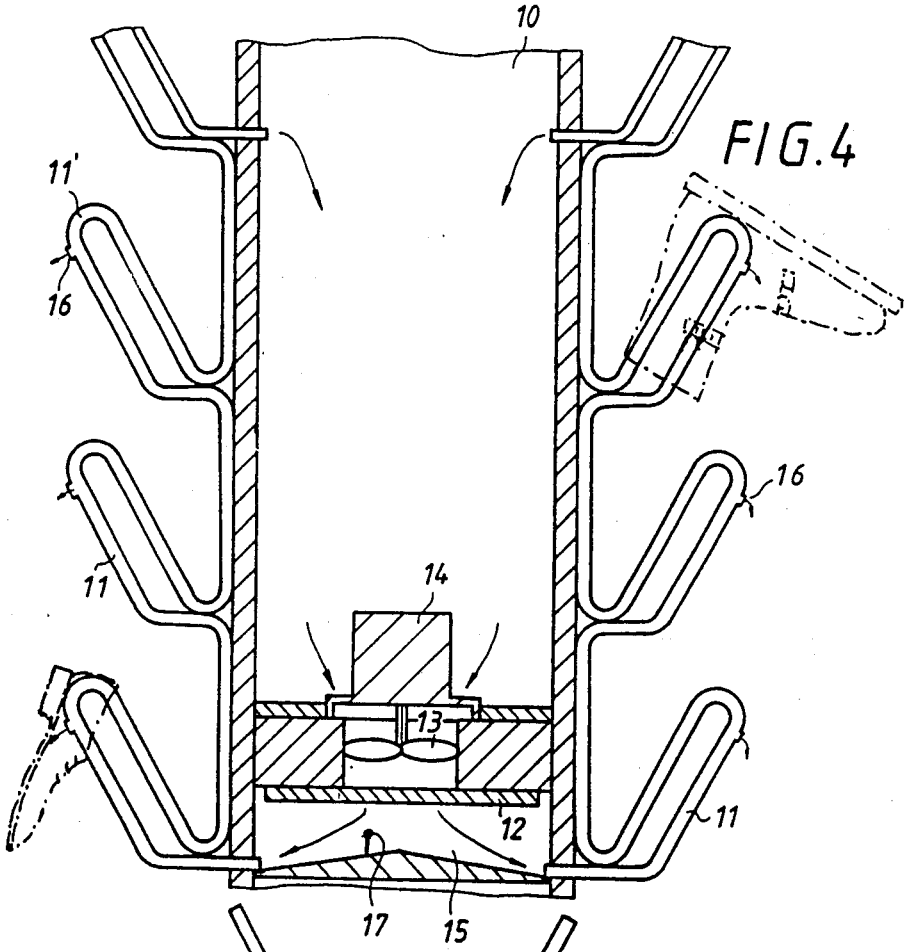
FIG. 4 is a vertical cross-section of a second embodiment of the invention.

In the embodiment of FIGS. 1 to 3, the drying device can be mounted on a wall and is comprised of pipe coils 1 attached to supports 2 and 3. The pipe coils open with one end in support 2 and the other end in support 3 and the two supports are connected by connecting pipe 4. A fan 5 is arranged in connecting pipe 4 whereby drying air can be blown into support 3. The drying air is heated to the desired temperature by a heating device 6 and the heated drying air then exits from the tube bends by way of the discharge ports 18. The outwardly extending tube bends are indicated by 1'. The drying devices can be subdivided into individual panels that can then be connected by means of connecting sleeves 7 or the like to form larger units whereby it is possible to obtain a drying device in a size appropriate to the the requirements.

Figure 5:
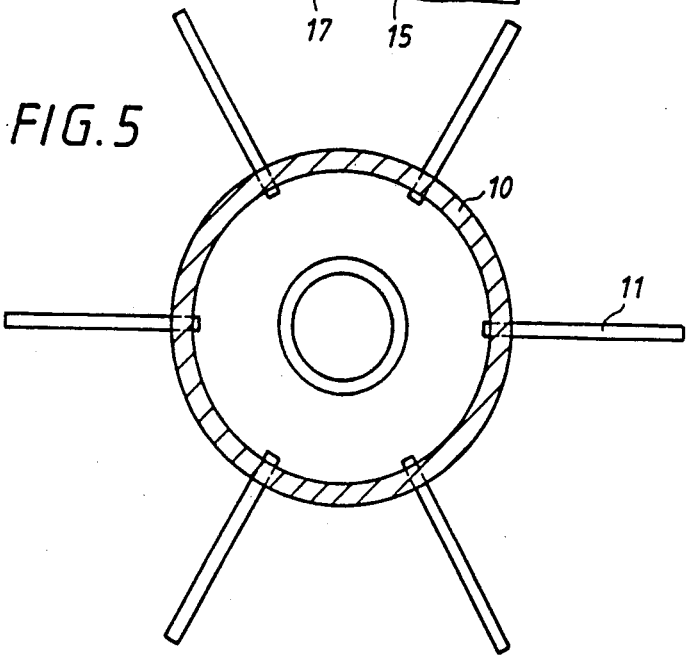
FIG. 5 is a plan view of the latter embodiment.

In the embodiment of FIGS. 4 and 5, a hollow cylinder 10 is provided on the outside jacket of which the pipe coils 11 are arranged along the cylinder's generatrix. The pipe coils 11 start out from a distributing chamber 15 arranged at the lower end of cylinder 10 and with their upper ends open into the zone of cylinder 10. Above the distributing chamber 15, a radiator 12 is provided through which air is blown into the distributing chamber 15 by a fan 13 driven by a motor 14. The warm air then flows from the distributing chamber through the pipe coils 11. Discharge ports 16 for the warm air are provided at the outwardly pointing tube bends 11' and these discharge ports are arranged in the zone of the outside limit of the protruding tube bends 11', to wit, in the zone of one of the ends of the curves of the tube bends 11'. Thereby, the air escapes laterally from the pipe coils 11 so that through appropriate slipping on of the shoes it is obtained that the air jet exiting through the discharge ports 16 reaches directly into the tips of the shoes whereby a continuous exchange of the air in the shoes is achieved and a congestion of humid, warm air within the shoes is prevented. By having the pipe coils 11 open into the upper range of cylinder 10, it is obtained that the fan 13 also draws in already preheated air whereby energy is saved.

In all the embodiments, the temperature of the heat carrying medium can be controlled automatically and temperature sensors can be installed in the system in the customary manner, with the temperature of the heat carrying medium maintained between 30° C. and 50° C. Such a temperature sensor is indicated at 17 in FIG. 2 and FIG. 4. In both instances, the temperature sensor is connected to the heating device at the outlet side.

Naturally, the most varied spatial arrangements of the heating tubes on carrier organs are possible. Thus, a panel wall can be provided corresponding to FIGS. 1 to 3 with pipe coils arranged on both sides which could be arranged in a room as a divider or as a suspended wall accessible from both sides. In place of an embodiment of FIGS. 4 and 5, it is also possible to arrange the pipe coils, e.g., on a support shaped as a square pipe, so that four rows of hanging elements would then be available for the items to be dried.

Various modifications of the device of the invention may be made without departing from the spirit or scope thereof and it should be understood that the invention is intended to be limited only as defined in the appended claims.

What we claim is:

1. A device for drying footwear comprising a holding element on which the footwear to be dried is slipped onto with at least one serpentine pipe for conducting warm air into the footwear through at least one discharge port and at least one carrier organ to distribute the warm air, characterized in that the holding elements are formed by tube bends (1',11') and adjacent legs of the serpentine pipe (1,11) whereby the discharge ports (18,16) are arranged in the area of the downward pointing end of the outer curve of the tube bend.

2. The device of claim 1 wherein the legs adjacent to the tube bends (1',11) of the serpentine pipe (1,11) are parallel.

3. A device of claim 1 wherein there are a plurality of holding elements.

* * * * *